US009935413B1

(12) United States Patent
Fowle

(10) Patent No.: US 9,935,413 B1
(45) Date of Patent: Apr. 3, 2018

(54) HINGE PIN WITH ELECTRICAL CONNECTION THROUGH A CYLINDRICAL PIN BODY

(71) Applicant: Samuel G. Fowle, San Francisco, CA (US)

(72) Inventor: Samuel G. Fowle, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/429,243

(22) Filed: Feb. 10, 2017

Related U.S. Application Data

(60) Provisional application No. 62/296,820, filed on Feb. 18, 2016.

(51) Int. Cl.

| | |
|---|---|
| ***H01R 39/00*** | (2006.01) |
| ***H01R 35/04*** | (2006.01) |
| ***E05D 5/10*** | (2006.01) |
| ***E05D 11/00*** | (2006.01) |

(52) U.S. Cl.
CPC ..... *H01R 35/04* (2013.01); *E05D 5/10* (2013.01); *E05D 11/0081* (2013.01); *E05D 2005/102* (2013.01); *E05Y 2900/00* (2013.01)

(58) Field of Classification Search
CPC ..... H01R 35/04; H01R 24/54; H01R 25/00; H01R 31/06; H01R 33/88; H01R 33/94; H01R 39/00; E05D 5/10; E05D 11/0081
USPC ..... 439/31, 300, 638
See application file for complete search history.

(56) References Cited

U.S. PATENT DOCUMENTS

| | | | | |
|---|---|---|---|---|
| 4,140,357 | A * | 2/1979 | Wolz | E05D 11/0081 174/86 |
| 4,412,711 | A | 11/1983 | Suska | |
| 5,941,619 | A | 8/1999 | Stieben et al. | |
| 6,079,993 | A * | 6/2000 | Laine | H01R 35/02 16/223 |
| 8,490,249 | B2 * | 7/2013 | Boegel-Poetter | E05D 11/0081 16/386 |
| 8,650,714 | B2 * | 2/2014 | Staude | E05D 11/0081 16/385 |
| 8,753,129 | B2 * | 6/2014 | Worley | H01R 13/04 439/31 |
| 9,115,518 | B2 * | 8/2015 | Herglotz | E05D 11/0081 |
| 9,328,954 | B2 * | 5/2016 | Kang | E05D 11/0081 |
| 2002/0076960 | A1 * | 6/2002 | Ibaraki | H01R 35/02 439/165 |
| 2002/0112320 | A1 | 8/2002 | Hayashi | |
| 2005/0266900 | A1 * | 12/2005 | Zou | H04M 1/0222 455/575.3 |
| 2007/0254495 | A1 * | 11/2007 | Arndt | H01R 35/02 439/31 |

(Continued)

*Primary Examiner* — Chandrika Prasad
(74) *Attorney, Agent, or Firm* — Young Basile Hanlon & MacFarlane, P.C.

(57) ABSTRACT

A hinge pin includes a pin body, a first electrical connector located at a first end of the pin body, a second electrical connector located at a second end of the pin body, and electrical conductors that electrically connect the first electrical connector and the second electrical connector. The hinge pin may be incorporated in a hinge to connect a first hinge part and a second hinge part for rotation. The hinge may be incorporated in an apparatus in which first and second wire harnesses are connected to the first and second electrical connectors of the hinge pin by third and fourth electrical connectors.

20 Claims, 5 Drawing Sheets

(56) References Cited

U.S. PATENT DOCUMENTS

| | | | | |
|---|---|---|---|---|
| 2008/0076270 | A1* | 3/2008 | Jao | H01R 35/025 439/31 |
| 2009/0149050 | A1* | 6/2009 | Lyu | H01R 27/00 439/310 |
| 2013/0126233 | A1 | 5/2013 | Nagayasu et al. | |
| 2013/0183841 | A1* | 7/2013 | Stevens | H01R 13/447 439/131 |

* cited by examiner

HINGE PIN WITH ELECTRICAL CONNECTION THROUGH A CYLINDRICAL PIN BODY

CROSS-REFERENCE TO RELATED APPLICATIONS

This application claims the benefit of U.S. Provisional Application No. 62/296,820, filed on Feb. 18, 2016, the content of which is hereby incorporated by reference in its entirety for all purposes.

TECHNICAL FIELD

The application relates generally to wiring connections.

BACKGROUND

Hinges are generally defined as movable joints or mechanisms that connect two structures in a manner that allows relative motion. Hinges are commonly used in architectural applications to mount a door for movement with respect to a door opening. Hinges are commonly used in automotive applications to connect movable components to structures such as a vehicle body or a vehicle frame of a vehicle. As one example, a hinge can be used to connect a side door of the vehicle to the vehicle body. As another example, hinges can be used to connect a rear hatch of the vehicle to the vehicle body.

In some applications, electrical connections are made between components on either side of a hinge. As one example, electrical connections can be made by a wire harness that extends from a door to a door frame separate from the hinge. To protect the wire harness, it may pass through a flexible tube that extends from the door to the door frame. As another example, electrical connections can be made by passing one or more electrical conductors through part of a hinge.

SUMMARY

One aspect of the disclosure is a hinge pin that includes a pin body, a first electrical connector located at a first end of the pin body, a second electrical connector located at a second end of the pin body, and electrical conductors that electrically connect the first electrical connector and the second electrical connector.

Another aspect of the disclosure is an apparatus that includes a first hinge part, a second hinge part, and a hinge pin. The hinge pin that connects the first hinge part to the second hinge part. The hinge pin has a pin body that defines a bearing surface that engages the first hinge part and the second hinge to allow relative rotation of the first and second hinge parts. The hinge pin also has a first electrical connector located at a first end of the pin body, a second electrical connector located at a second end of the pin body, and electrical conductors that electrically connect the first electrical connector and the second electrical connector.

Another aspect of the disclosure is an apparatus that includes a first hinge part, a second hinge part, and a hinge pin that connects the first and second hinge parts for rotation. The hinge pin has a pin body, a first electrical connector that is connected to the pin body at a first end of the pin body, and an internal space that extends from the first end of the pin body to a second end of the pin body. The apparatus also includes a second electrical connector that is spaced from the hinge pin, and a wiring harness portion that is electrically connected to the first electrical connector, extends through the internal space of the pin body, extends out of the internal space of the pin body at the second end of the pin body, and is electrically connected to the second electrical connector.

BRIEF DESCRIPTION OF THE DRAWINGS

The description herein is made with reference to the drawings described below.

DETAILED DESCRIPTION

The following disclosure relates to hinge that has an integrated wiring connection. Integrating wiring into a hinge may eliminate a separate wiring connection between structures such as a door and a door opening. Passing wires through a passage in a hinge requires either that the passage be large enough to allow wiring connectors to pass through the passage along with the wires, or that the wiring connectors be installed after the wires are passed through the hinge. The hinges described herein integrate conductors and wiring connectors into a portion of the hinge, such as a hinge pin. This allows other wires or wire harness connectors to be connected after assembly of the hinge.

Figure 1:
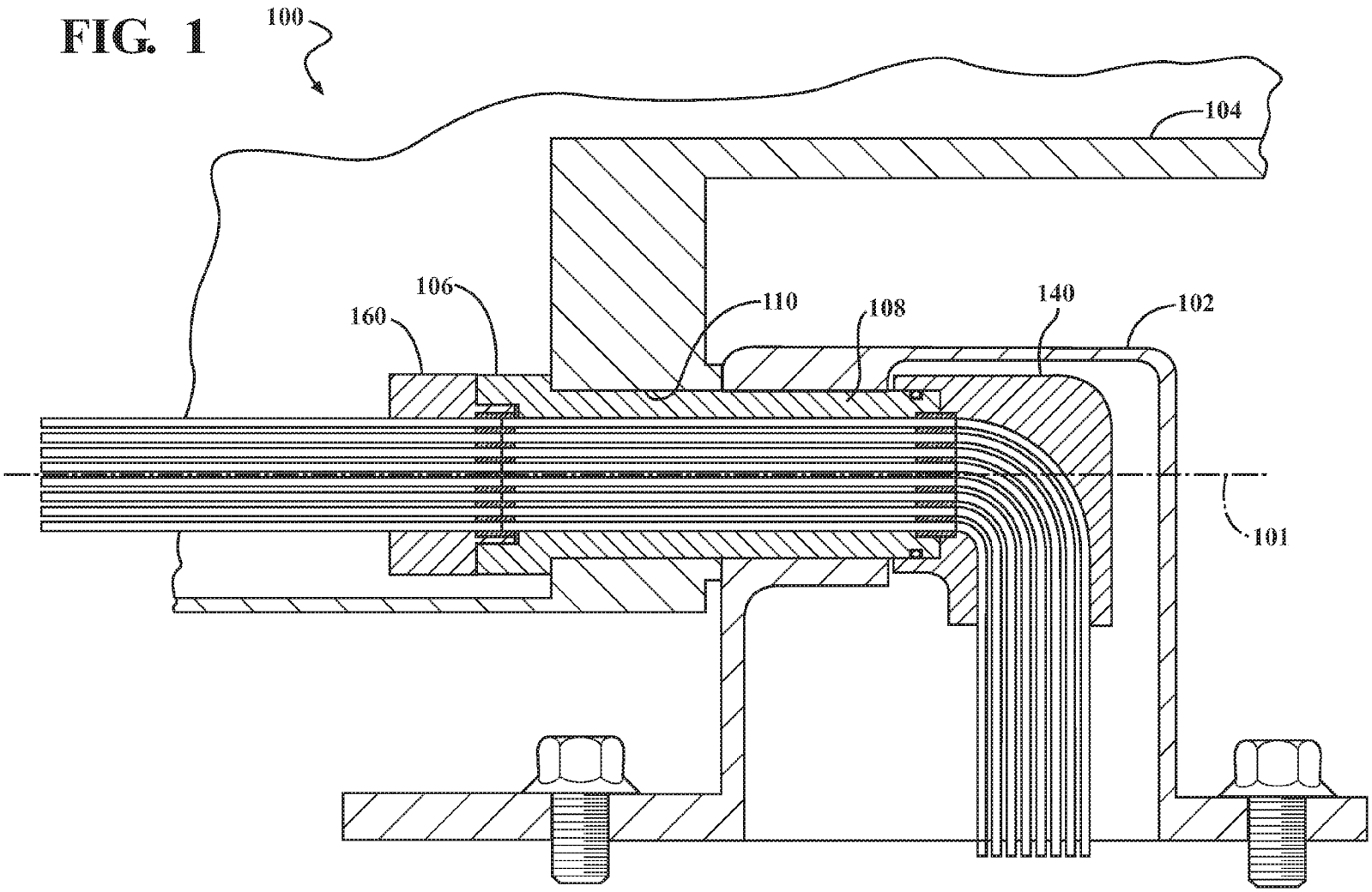
FIG. 1 is a side cross-section view that shows a hinge that has an integrated wiring connection.

FIG. 1 shows a hinge 100. The hinge 100 includes a first hinge part 102, a second hinge part 104, and a hinge pin 106 having an integrated wiring connection. The hinge pin 106 connects the first and second hinge parts 102, 104 for rotation on a hinge axis 101. Although the hinge 100 in the illustrated example is a two-knuckle hinge having a specific structural configuration, it should be understood that the hinge pin 106 and integrated wiring connection may be applied to other types of hinge structures having configurations other than the configuration shown in the illustrated example.

The first and second hinge parts 102, 104 may be any structures that are to be connected for rotation with respect to one another. The first hinge part 102 has a first aperture 108 defined through it along the hinge axis 101 and the second hinge part 108 has a second aperture 110 defined through it along the hinge axis 101. The first aperture 108 and the second aperture 110 may both be circular in shape, or one or the first aperture 108 and the second aperture 110 may include a non-circular feature to restrain rotation relative to the hinge pin 106. For example one of the first aperture 108 or the second aperture 110 may incorporate a feature such as a spline or key that engages a corresponding feature of the hinge pin 106 to restrain relative rotation.

The hinge pin 106 extends through the first aperture 108 of the first hinge part 102 and through the second aperture 110 of the second hinge part 104 to connect the first hinge part 102 to the second hinge part 104. The first and second hinge parts 102, 104 may be connected by the hinge pin such that the first hinge part 102 is held in a fixed position while the second hinge part 104 rotates with respect to the first hinge part 102 around the hinge axis 101 of the hinge 100. Alternatively, the second hinge part 104 may be held in a fixed position while the first hinge part 102 rotates with respect to the second hinge part 104 around the hinge axis 101, or both of the first and second hinge parts 102, 104 may be non-fixed with the first and second hinge parts 102, 104 rotating relative to each other around the hinge axis 101.

As one example, the hinge 100 may be used in an architectural application in which the first hinge part 102 is connected to a door frame and the second hinge part 104 is connected to a door. As another example, the hinge 100 may be used in an automotive application in which the first hinge part 102 is connected to a vehicle body structure or vehicle frame portion and the second hinge part 104 is connected to door, rear hatch, tailgate, or other portion of the vehicle that is moveable relative to the vehicle body and/or frame of the vehicle.

Figure 2:
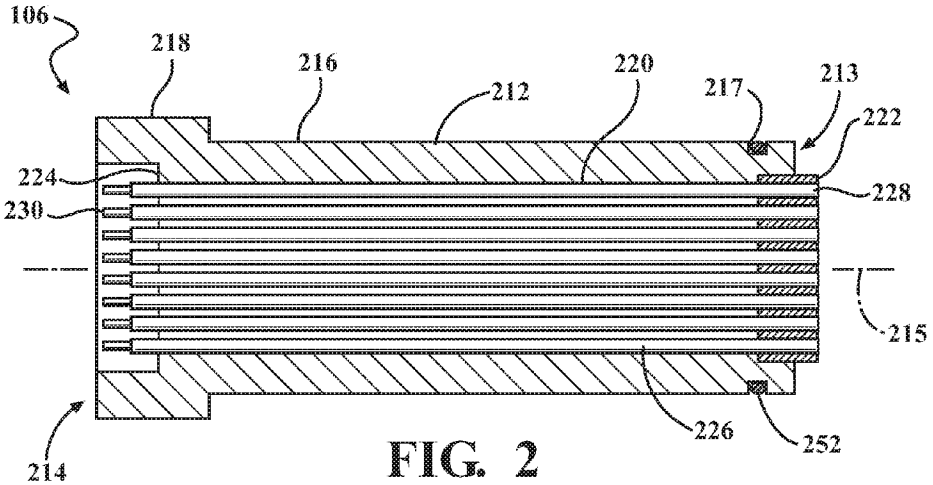
FIG. 2 is a side cross-section view that shows a hinge pin.

As best seen in FIG. 2, the hinge pin 106 includes a pin body 212 that extends along a pin axis 215. As incorporated in the hinge 100, the pin axis 215 is aligned with the hinge axis 101.

The pin body 212 may be a generally cylindrical structure that extends along the hinge axis 101. The pin body 212 serves as a structural element for connecting the first and second hinge parts 102, 104. Thus, the pin body 212 may be a load bearing element that transfers forces between the first and second hinge parts 102, 104. The pin body 212 also includes the bearing surfaces that facilitate relative rotation of the first and second hinge parts 102, 104. The pin body 212 is formed from a material that is suitable for transferring forces between the first and second hinge parts 102, 104. As an example, the pin body 212 may be formed from metal such as steel.

The pin body 212 has an exterior surface 216. At least part of the exterior surface 216 is generally cylindrical and has a diameter complementary to the first and second apertures 108. The cylindrical part of the exterior surface 216 of the pin body 212 serves as a bearing surface that engages one of the first and second hinge parts 102, 104 along the one of the first and second apertures 108, 110 to allow rotation of one of the first hinge part 102 or the second hinge part 104 with respect to the hinge pin 106.

The pin body 212 may have a widened portion 218 at one end, with the width of the widened portion 218 being larger than the diameter of the first aperture 108 and the second aperture 110. The widened portion 218 of the pin body 212 prevents the pin body 212 from passing completely through the first and second apertures 108, 110 while allowing the pin body 212 to extend through the first and second apertures 108, 110.

The pin body 212 may have an internal passage 220 that extends from a first end 213 of the pin body 212 to a second end 214 of the pin body 212. As an example, the pin body 212 may be a generally tubular structure.

The hinge pin 106 includes a first electrical connector 222, a second electrical connector 224, and conductors 226 that interconnect the first electrical connector 222 and the second electrical connector 224. The first electrical connector 222, the second electrical connector 224, and the conductors 226 define the integrated wiring connection of the hinge pin 106.

The first and second electrical connectors 222, 224 are structures that are able to connect to corresponding electrical connectors in order to transmit electrical power and/or electrical signals. For example, the first electrical connector 222 and the second electrical connector 224 may each include electrical contacts 228, 230 that are configured to engage electrical contacts of corresponding electrical connectors. In the illustrated implementation, the electrical contacts 228 of the first electrical connector 222 are plug contacts and the electrical contacts 228 of the second electrical connector 224 are pin contacts. More generally, the electrical contacts 228 of the first electrical connector 222 may include at least one of pin contacts or plug contacts and the electrical contacts 230 of the second electrical connector 224 may include at least one of pin contacts or plug contacts. Pin contacts and plug contacts are described only as examples of electrical contacts, and other electrically conductive structures can be used as the electrical contacts 228 of the first electrical connector 222 and the electrical contacts 230 of the second electrical connector 224.

The first and second electrical connectors 222, 224 are positioned at opposite ends of the hinge pin 106. For example, the first electrical connector 222 may be positioned at the first end 213 of the pin body 212, and the second electrical connector 224 may be positioned at the second end 214 of the pin body 212.

In the illustrated implementation, the first and second electrical connectors 222, 224 are positioned at least partially in the internal passage 220 of the pin body 212. It should be understood that the first and second electrical connectors 222, 224 could be located on any surface of the pin body 212.

The first and second electrical connectors 222, 224 may be fixed to the pin body 212. Fixing the first and second electrical connectors 222, 224 to the pin body 212 may include preventing motion of the first and second electrical connectors 222, 224 with respect to the pin body 212 in a single linear or rotational direction, in multiple linear and/or rotational directions, or in all linear and rotational directions. In the illustrated example, the first and second electrical connectors 222, 224 are restrained from rotating and translating with respect to the pin body 212.

Numerous structures and methods can be used to fix the first and second electrical connectors 222, 224 with respect to the pin body 212. As one example, the first and second electrical connectors 222, 224 may be fixed to the pin body 212 by a friction fit. As another example, the first and second electrical connectors 222,224 may be fixed to the pin body 212 by an adhesive. As another example, the first and second electrical connectors may be fixed to the pin body 212 by a mechanical fastener or coupler.

In some implementations, the internal passage 220 of the pin body 212 is completely occupied by the integrated wiring connection components such as the first and second electrical connectors 222, 224 and the conductors 226. As one example, excess space adjacent to the conductors 226 could be occupied by a potting compound or similar material. As another example, the conductors 226 could be integrated into a modular component that is fabricated prior to placement in the internal passage 220 and is configured to occupy the internal passage 220 completely, such as a cylindrical module that is made of nonconductive material and has the conductors 226 embedded in it. Optionally, such as modular structure could have the first and second electrical connectors 222, 224 attached to it prior to placement in the internal passage 220.

Figure 3:
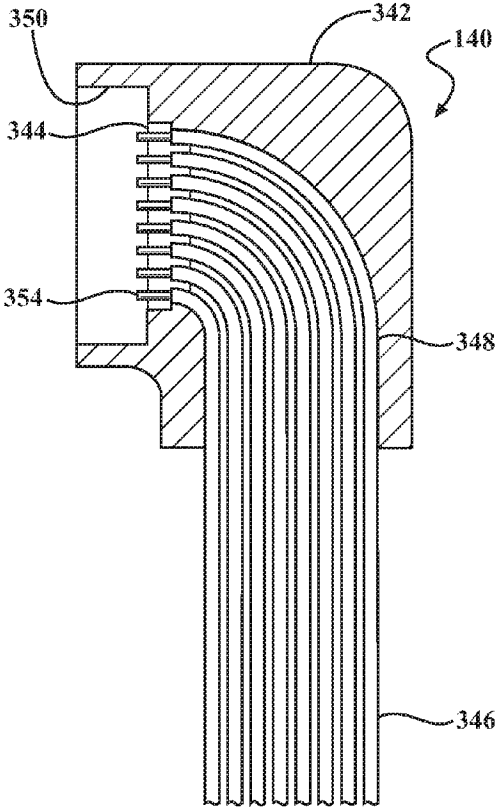
FIG. 3 is a side cross-section view that shows a first harness connector.

As shown in FIG. 1, a first harness connector 140 is disposed adjacent to or within the first hinge part 102 and is connected to the hinge pin 106. As best seen in FIG. 3, the first harness connector 140 includes a connector body 342, a third electrical connector 344, and a portion of a first wire harness 346 that is electrically connected to the third electrical connector 344. The connector body 342 is formed from any suitable material such as plastic or metal. The first wire harness 346 includes one or more electrical conductors.

The connector body 342 serves as a housing for the third electrical connector 344 and for part of the first wire harness 346. The third electrical connector 344 and part of the first wire harness 346 are disposed in an internal space 348 defined within the connector body 342. The third electrical connector 344 may be disposed at one end of the internal space 348 of the connector body 342, and the first wire harness 346 may extend out of an opposite end of the internal space 348 of the connector body 342.

In the illustrated example the connector body 342 has an elbow-shaped configuration with the ends of the internal space 348 and thus the third electrical connector 344 and the exit of the first wire harness 346 being disposed at a 90 degree angle with respect to one another. It should be understood that any geometry could be adopted for the connector body 342.

The connector body 342 may have a structural configuration for mechanically connecting the first harness connector 140 to the hinge pin 106. In the illustrated example, the connector body has a tubular end portion 350 with an internal annular protrusion 352 that extends radially inward from an internal surface of the tubular end portion 350. The first end 213 of the pin body 212 is receivable in the tubular end portion 350 such that the internal annular protrusion 352 engages a complementary structure formed on the pin body 212 such as an annular groove 217 to define a push on snap-fit type connection. Other structures can be used to mechanically connect the first harness connector 140 to the hinge pin 106.

The third electrical connector is configured to electrically connect to the first electrical connector 222 for transmission of electrical power and/or electrical signals. The third electrical connector 344 may be similar to the first and second electrical connectors 222, 224. The third electrical connector 344 may include electrical contacts 354 such as pin contacts, as shown in the illustrated example, or plug contacts.

Figure 4:
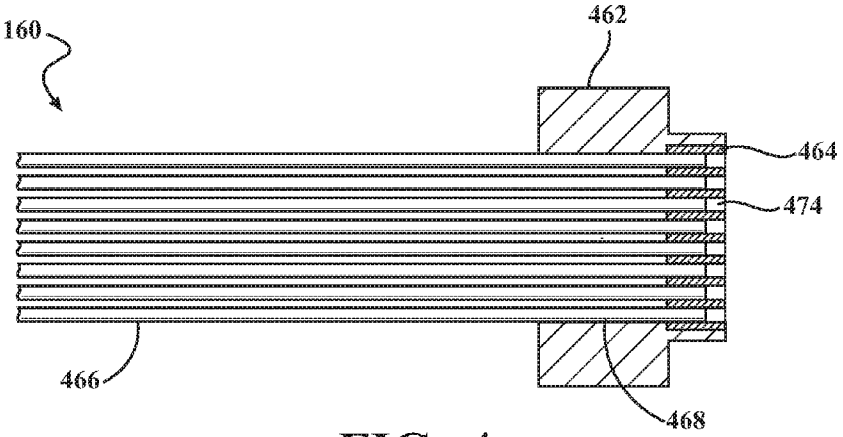
FIG. 4 is a side cross-section view that shows a second harness connector.

As shown in FIG. 1, a second harness connector 160 is disposed adjacent to or within the second hinge part 104 and is connected to the hinge pin 106. As best seen in FIG. 4, the second harness connector 160 includes a connector body 462, a fourth electrical connector 464, and a portion of a second wire harness 466 that is electrically connected to the fourth electrical connector 464. The connector body 462 is formed from any suitable material such as plastic or metal. The second wire harness 466 includes one or more electrical conductors.

The connector body 462 serves as a housing for the fourth electrical connector 464 and for part of the second wire harness 466. The fourth electrical connector 464 and part of the second wire harness 466 are disposed in an internal space 468 defined within the connector body 462. The fourth electrical connector 464 may be disposed at one end of the internal space 468 of the connector body 462, and the second wire harness 466 may extend out of an opposite end of the internal space 468 of the connector body 462.

In the illustrated example the connector body 462 has a linear configuration and extends along the hinge axis 101. It should be understood that any geometry could be adopted for the connector body 462.

The connector body 462 may have a structural configuration for mechanically connecting the second harness connector 160 to the hinge pin 106. In the illustrated example, the connector body has a reduced-diameter end portion that is configured to extend into the second end 214 of the pin body 212 and engage an internal surface 219 of the widened portion 218 of the pin body 212 to define a friction fit that resists mechanical disconnection of the second harness connector 160 from the hinge pin 106. Other structures can be used to mechanically connect the second harness connector 160 to the hinge pin 106.

The fourth electrical connector 464 is configured to electrically connect to the second electrical connector 224 for transmission of electrical power and/or electrical signals. The fourth electrical connector 464 may be similar to the first and second electrical connectors 222, 224. The fourth electrical connector 464 may include electrical contacts 474 such as plug contacts, as shown in the illustrated example, or pin contacts.

A method of assembling the hinge 100 will be explained with reference to FIGS. 5-8.

Figure 5:
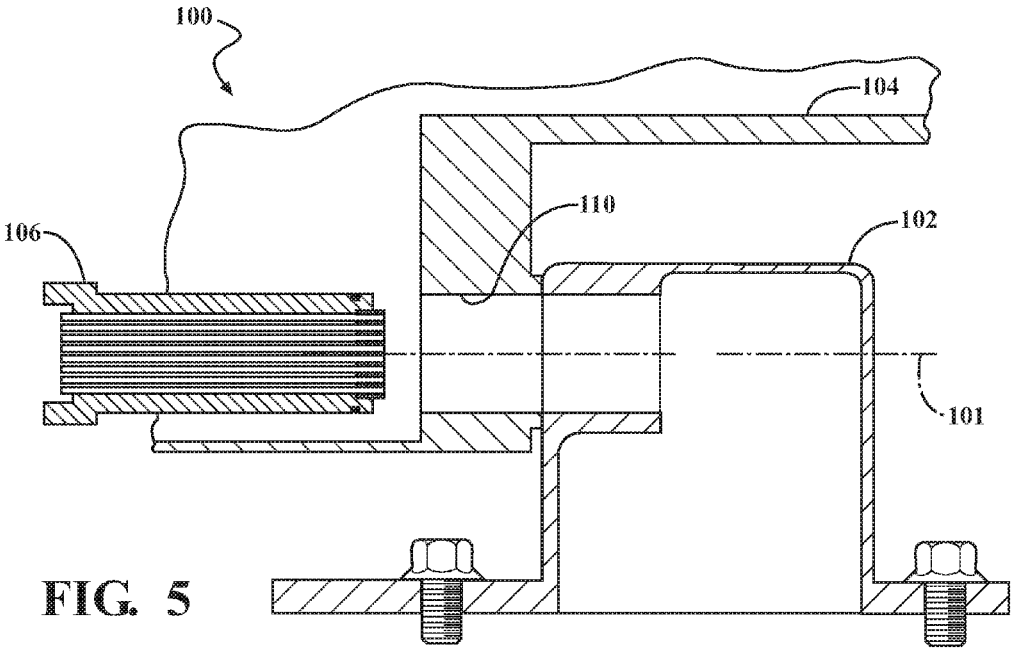
FIG. 5 is a side cross-section view that shows a first stage of assembly of the hinge.
Figure 6:
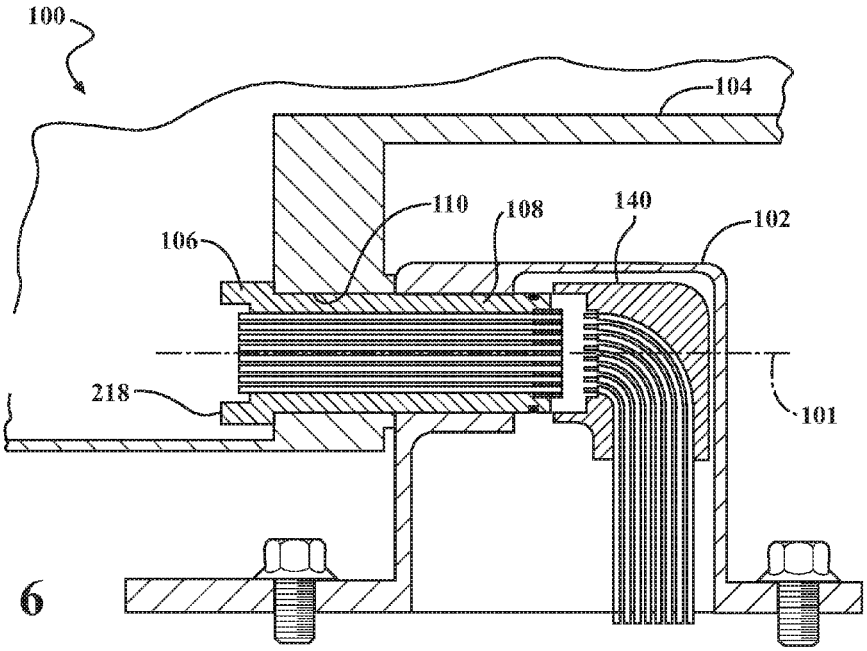
FIG. 6 is a side cross-section view that shows a second stage of assembly of the hinge.
Figure 7:
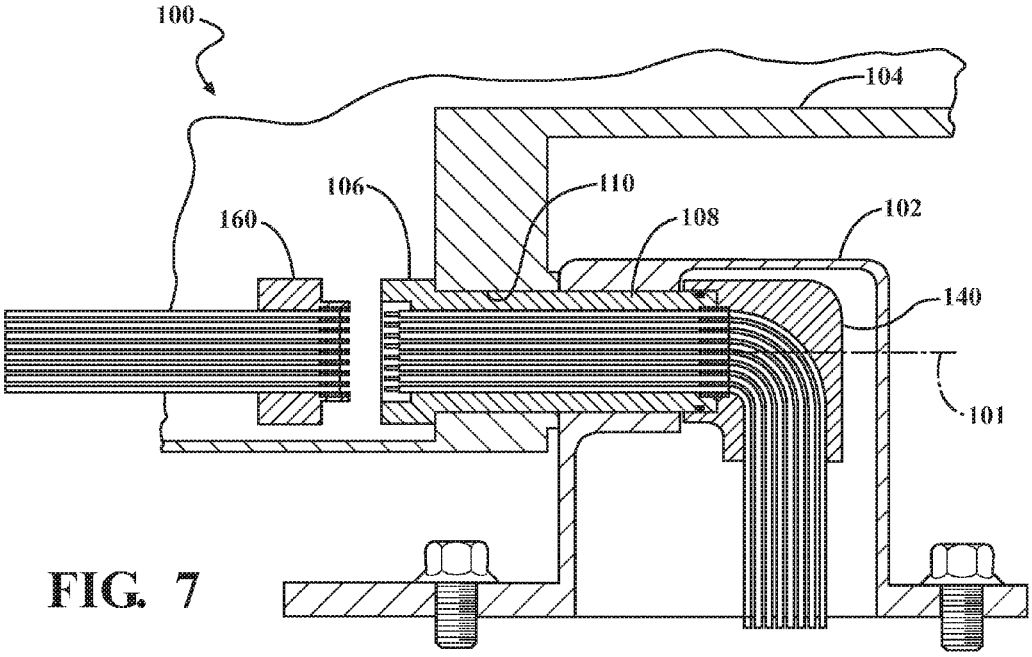
FIG. 7 is a side cross-section view that shows a third stage of assembly of the hinge.
Figure 8:
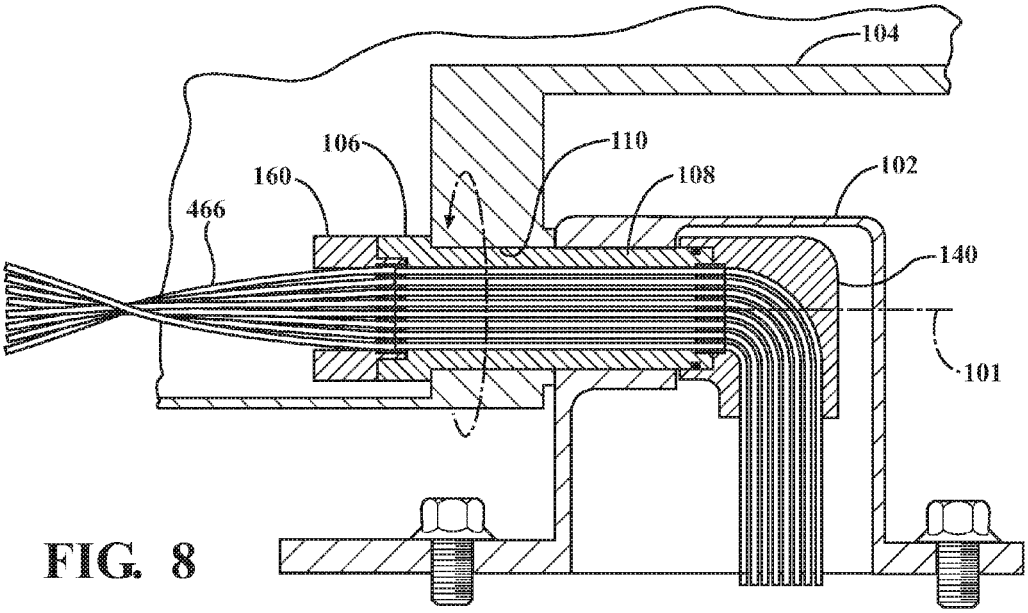
FIG. 8 is a side cross-section view that shows a fourth stage of assembly of the hinge and rotation of a second hinge part with respect to a first hinge part.

Initially, as shown in FIG. 5, the first hinge part 102 is connected to the second hinge part 104, such that the first and second hinge parts 102, 104 are relatively rotatable and the first aperture 108 is aligned with the second aperture 110. The hinge pin 106 is positioned outside of the second aperture 110, in alignment with the hinge axis 101. The hinge pin 106 is then moved along the hinge axis 101 into the second aperture 110 and then into the first aperture 108, as shown in FIG. 6. The hinge pin 106 is fully inserted into the first and second apertures 108, 110 when the hinge pin 106 extends into the first hinge part 102 and the widened portion 218 of the hinge pin 106 engages the second hinge part 104 to restrain further axial motion of the hinge pin 106 along the pin axis 215. The first harness connector 140 is then moved into the first hinge part 102 at a location adjacent to and aligned with the hinge pin 106. The first harness connector 140 is then moved into engagement with the hinge pin 106 to mechanically and electrically connect the first harness connector 140 with respect to the hinge pin 106, as shown in FIG. 7. The second harness connector 160 is then moved within the second hinge part 104 to a location adjacent to and aligned with the hinge pin 106. As shown in FIG. 8, the second harness connector 160 is then moved into engagement with the hinge pin 106 to mechanically and electrically connect the second harness connector 160 with respect to the hinge pin 106. In the illustrated example, the hinge pin 106 is restrained from rotating with respect to the first hinge part 102 such as by interaction of complementary mechanical features, and the second hinge part 104 rotates on the hinge axis 101 with respect to the first hinge part 102 and the hinge pin 106 while the position of the hinge pin 106 with respect to the first hinge part 102 remains fixed.

Figure 9:
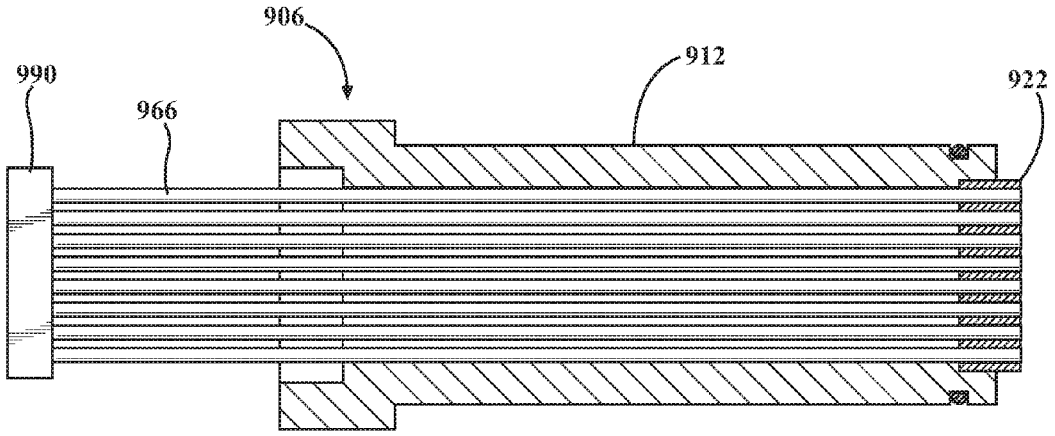
FIG. 9 is a side cross-section view that shows a hinge pin according to an alternative implementation.

FIG. 9 shows a hinge pin 906 according to an alternative implementation. The hinge pin 906 is similar to the hinge pin 106 except as noted and can be incorporated in the hinge 100 in place of the hinge pin 906.

The hinge pin 906 includes a wiring connector 922 that is located at an end of a pin body 912 and is fixed to the pin body 912. The wiring connector 922 is similar to the first wiring connector 122 of the hinge pin 106. The hinge pin 906 does not include a wiring connector at an opposite and a wire harness portion 966 is connected directly to the wiring connector 922 and extends through an internal passage 920, exits the opposite end of the hinge pin 906, and is connected to an external wiring connector 990 that is not fixed to the pin body 912. Thus, the hinge pin 906 includes a wiring connector 922 and a wire harness portion 966, and the hinge pin may be fabricated and used with the hinge 100 with the wiring connector 922 located at either end of the pin body 912, and one of the first harness connector 140 or the second harness connector 160 omitted as appropriate. In a further alternative implementation, a hinge pin lacks wiring connectors and a wire harness portion extends through an internal passage of the hinge pin between two non-fixed external wiring connectors.

Figure 10:
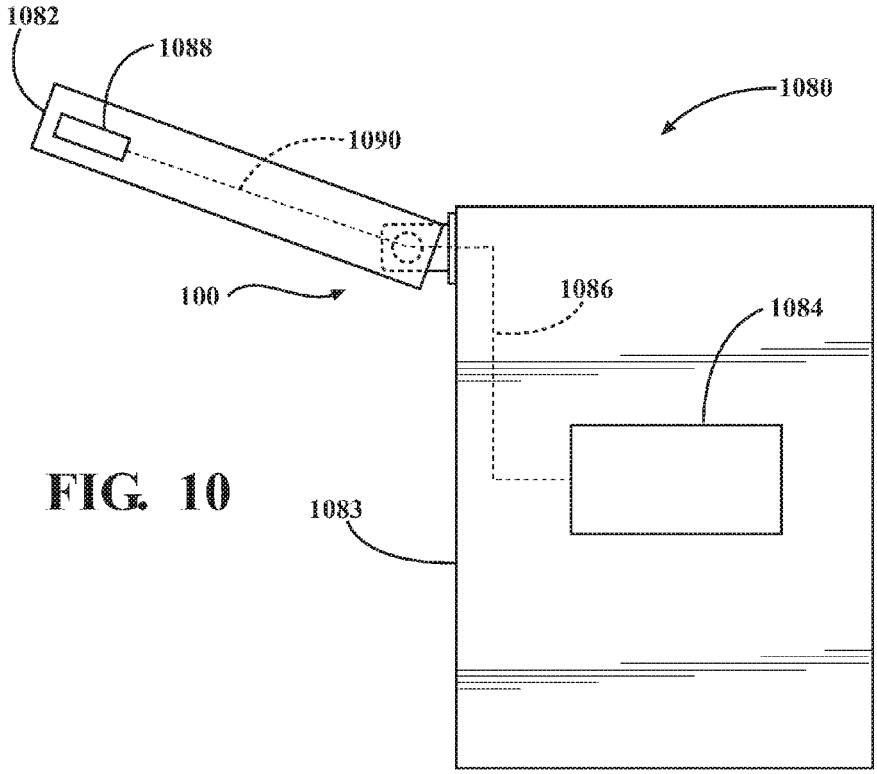
FIG. 10 shows a structure that incorporates the hinge.

FIG. 10 shows an assembly 1080 in which a first structure 1081 is connected to a second structure 1082 by the hinge 100 to allow the second structure 1082 to rotate between open and closed positions relative to the first structure 1081. As an example, the second structure 1082 may be a door and the first structure 1081 may include a door opening 1083 that is obstructed when the second structure 1082 is in the closed position and unobstructed when the second structure 1082 is in the open position.

A first electrical component 1084 is connected to and/or located in the first structure 1081. A first wire harness 1086 connects the first electrical component 1084 to the hinge 100. A second electrical component 1088 is connected to and/or located in the second structure 1082. A second wire harness 1090 connects the second electrical component 1088 to the hinge 100. As one example the first electrical component 1084 may be an electrical power source and the second electrical component 1088 may be a device that uses electrical power. As another example the first electrical component 1084 may be a computer or controller and the second electrical component 1088 may be a sensor that transmits signals and/or data to the first electrical component 1084. As another example the first electrical component 1084 may be a computer or controller and the second electrical component 1088 may be a component that operates in response to signals and/or data received from the first electrical component 1084. As another example the first electrical component 1084 may be a computer or controller and the second electrical component 1088 may be a computer or controller, wherein the first and second electrical components 1084, 1088 send and receive signals and/or data to each other.

The first and second structures 1081, 1082 may be any structures that are to be mounted for relative rotation around an axis. As one example, the first structure 1081 may be a vehicle body and the second structure 1082 may be a side door of a vehicle. As one example, the first structure 1081 may be a vehicle body and the second structure 1082 may be a rear hatch of a vehicle. The hinge 100 is well-suited to such applications because wiring is protected within the hinge 100, which shields the wiring from damage and dirt. Placing wiring in the hinge 100 also reduces motion of the wiring during movement of hinge-connected parts between open and closed positions. Placing wiring in the hinge 100 may also enhance aesthetics.

What is claimed is:

1. A hinge pin, comprising:

a pin body having a cylindrical surface that extends around a longitudinal axis;

a first electrical connector located at a first end of the pin body;

a second electrical connector located at a second end of the pin body; and electrical conductors that extend through the pin body to electrically connect the first electrical connector and the second electrical connector.

2. The hinge pin of claim 1, wherein:

the first and second electrical connectors are fixed to the pin body, the first and second electrical connectors each have electrical contacts, the electrical contacts of the first electrical connector include at least one of pin contacts or plug contacts, the electrical contacts of the second electrical connector include at least one of pin contacts or plug contacts, the pin body extends along the longitudinal axis, the pin body defines an internal space, the internal space extends along the longitudinal axis from the first end of the pin body to the second end of the pin body, the first electrical connector is located at the first end of the internal space, the second electrical connector is located at the second end of the internal space, the electrical conductors are located in the internal space, and the pin body has a widened portion.

3. The hinge pin of claim 1, wherein the first and second electrical connectors are fixed to the pin body.

4. The hinge pin of claim 1, wherein the first and second electrical connectors each have electrical contacts.

5. The hinge pin of claim 4, wherein the electrical contacts of the first electrical connector include at least one of pin contacts or plug contacts and the electrical contacts of the second electrical connector include at least one of pin contacts or plug contacts.

6. The hinge pin of claim 1, wherein the pin body defines an internal space, the first electrical connector is located at the first end of the internal space, the second electrical connector is located at the second end of the internal space, and the electrical conductors are located in the internal space.

7. The hinge pin of claim 6, wherein the pin body extends along the longitudinal axis, and the internal space extends along the longitudinal axis from the first end of the pin body to the second end of the pin body.

8. The hinge pin of claim 1, wherein the pin body is generally cylindrical.

9. The hinge pin of claim 1, wherein the pin body has a widened portion.

10. An apparatus, comprising:

a first hinge part;

a second hinge part; and a hinge pin that connects the first hinge part to the second hinge part, the hinge pin having a pin body that defines a bearing surface that engages the first hinge part and the second hinge part to allow relative rotation of the first and second hinge parts, a first electrical connector located at a first end of the pin body, a second electrical connector located at a second end of the pin body, and electrical conductors that electrically connect the first electrical connector and the second electrical connector.

11. The hinge pin of claim 10, wherein the pin body defines an internal space, the first electrical connector is located at the first end of the internal space, and the second electrical connector is located at the second end of the internal space.

12. The hinge pin of claim 11, wherein the electrical conductors are located in the internal space.

13. The hinge pin of claim 12, wherein the pin body extends along a longitudinal axis, and the internal space extends along the longitudinal axis from the first end of the pin body to the second end of the pin body.

14. The hinge pin of claim 10, wherein at least part of the bearing surface is cylindrical.

15. The hinge pin of claim 10, wherein the pin body has a widened portion.

16. The hinge pin of claim 10, wherein the first and second electrical connectors are fixed to the pin body and the first and second electrical connectors each have electrical contacts.

17. The hinge pin of claim 10, wherein the electrical contacts of the first electrical connector include at least one of pin contacts or plug contacts and the electrical contacts of the second electrical connector include at least one of pin contacts or plug contacts.

18. The hinge pin of claim 10, wherein:

the pin body defines an internal space, the first electrical connector is located at the first end of the internal space, the second electrical connector is located at the second end of the internal space, the electrical conductors are located in the internal space, the pin body extends along a longitudinal axis, and the internal space extends along the longitudinal axis from the first end of the pin body to the second end of the pin body, at least part of the bearing surface is cylindrical, the pin body has a widened portion, the first and second electrical connectors are fixed to the pin body and the first and second electrical connectors each have electrical contacts, the electrical contacts of the first electrical connector include at least one of pin contacts or plug contacts, electrical contacts of the second electrical connector include at least one of pin contacts or plug contacts, a first wire harness having a third electrical connector that is connected to the first electrical connector; and a second wire harness having a fourth electrical connector that is connected to the second electrical connector.

19. An apparatus, comprising:

a first hinge part;

a second hinge part;

a hinge pin that connects the first and second hinge parts for rotation, the hinge pin having a pin body, a first electrical connector that is connected to the pin body at a first end of the pin body, and an internal space that extends from the first end of the pin body to a second end of the pin body;

a second electrical connector that is spaced from the hinge pin; and a wiring harness portion that is electrically connected to the first electrical connector, extends through the internal space of the pin body, extends out of the internal space of the pin body at the second end of the pin body, and is electrically connected to the second electrical connector.

20. The hinge pin of claim 19, wherein:

the pin body extends along a longitudinal axis, and the internal space extends along the longitudinal axis from the first end of the pin body to the second end of the pin body, the pin body includes a bearing surface that engages the first hinge part and the second hinge to allow relative rotation of the first and second hinge parts, at least part of the bearing surface is cylindrical, the pin body has a widened portion, the first and second electrical connectors each have electrical contacts, the electrical contacts of the first electrical connector include at least one of pin contacts or plug contacts, and electrical contacts of the second electrical connector include at least one of pin contacts or plug contacts.

* * * * *